US006331049B1

(12) United States Patent
Leban

(10) Patent No.: US 6,331,049 B1
(45) Date of Patent: Dec. 18, 2001

(54) PRINTHEAD HAVING VARIED THICKNESS PASSIVATION LAYER AND METHOD OF MAKING SAME

(75) Inventor: Marzio Leban, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/267,216

(22) Filed: Mar. 12, 1999

(51) Int. Cl.[7] ..... B41J 2/05
(52) U.S. Cl. ..... 347/64; 347/63
(58) Field of Search ..... 347/61, 62, 63, 347/64, 65

(56) References Cited

U.S. PATENT DOCUMENTS

| | | | | |
|---|---|---|---|---|
| 4,339,762 | | 7/1982 | Shirato et al. | 347/62 |
| 4,354,309 | | 10/1982 | Gardiner et al. | 438/564 |
| 4,513,298 | | 4/1985 | Scheu | 347/64 |
| 4,535,343 | | 8/1985 | Wright et al. | 347/64 |
| 4,616,408 | | 10/1986 | Lloyd | 29/611 |
| 4,686,544 | * | 8/1987 | Ikeda et al. | 347/64 |
| 4,792,818 | * | 12/1988 | Eldridge et al. | 347/63 |
| 4,872,028 | | 10/1989 | Lloyd | 347/14 |
| 4,931,813 | | 6/1990 | Pan et al. | 347/62 |
| 4,951,063 | | 8/1990 | Hawkins et al. | 347/62 |
| 4,982,199 | | 1/1991 | Dunn | 347/15 |
| 4,990,939 | * | 2/1991 | Sekiya et al. | 347/62 |
| 5,066,963 | * | 11/1991 | Kimura et al. | 347/62 |
| 5,083,137 | | 1/1992 | Badyal et al. | 347/14 |
| 5,168,284 | | 12/1992 | Yeung | 347/17 |
| 5,187,500 | | 2/1993 | Bhorquez et al. | 347/57 |
| 5,194,877 | | 3/1993 | Lam et al. | 347/63 |
| 5,227,812 | | 7/1993 | Watanabe et al. | 347/50 |
| 5,257,042 | | 10/1993 | Buhler | 347/64 |
| 5,357,081 | | 10/1994 | Bohorquez | 219/497 |
| 5,530,465 | | 6/1996 | Hasegawa et al. | 347/70 |
| 5,636,441 | | 6/1997 | Meyer et al. | 29/890.1 |
| 5,660,739 | * | 8/1997 | Ozaki et al. | 347/62 |
| 5,682,188 | | 10/1997 | Meyer et al. | 347/61 |
| 5,883,650 | | 3/1999 | Figueredo et al. | 347/62 |
| 6,007,188 | | 12/1999 | MacLeod et al. | 347/65 |
| 6,042,221 | * | 3/2000 | Komuro | 347/62 |
| 6,070,969 | * | 6/2000 | Buonanno | 347/64 |
| 6,224,195 | * | 5/2001 | Maru et al. | 347/60 |

FOREIGN PATENT DOCUMENTS

| | | | |
|---|---|---|---|
| 0729834A2 | 9/1996 | (EP) | B41J/2/05 |
| 0750991A2 | 1/1997 | (EP) | B41J/2/14 |
| 0750990A2 | 9/1997 | (EP) | B41J/2/14 |
| 0794057A1 | 9/1997 | (EP) | B41J/2/16 |
| 0816089A2 | 1/1998 | (EP) | B41J/2/14 |
| 0825026A2 | 2/1998 | (EP) | B41J/2/16 |
| 0887186A1 | 12/1998 | (EP) | B41J/2/125 |
| 07276639 | 10/1995 | (JP) | B41J/3/04 |

OTHER PUBLICATIONS

European Search Report; Dated Nov. 9, 2000.

E. V. Bhaskar, J. S. Aden "Development of the Thin–Film Structure for the ThinkJet Printhead" Hewlett–Packard Journal, May 1985, pp. 27–33.

R. A. Askeland, W. D. Childers, W. R. Sperry, "The Second–Generation Thermal InkJet Structure", Hewlett–Packard Journal, Aug. 1988, pp. 28–31.

J. S. Aden, et al. "The Third–Generation HP Thermnal InkJet Printhead" Hewlett–Packard Journal, Feb. 1994, pp. 41–45.

* cited by examiner

*Primary Examiner*—John Barlow
*Assistant Examiner*—Blaise L. Mouttet

(57) ABSTRACT

A printhead for an inkjet or like printing apparatus having a passivation layer of varied thickness. The passivation layer is relatively thin over the ink expulsion element to reduce the energy required to expel ink. The passivation layer is relatively thick over other regions of the substrate, particularly those regions in which circuitry or the like is provided. The increased thickness over the circuitry protects against capacitive coupling and the like. Methods of forming the varied thickness passivation layer are also disclosed.

15 Claims, 1 Drawing Sheet

PRINTHEAD HAVING VARIED THICKNESS PASSIVATION LAYER AND METHOD OF MAKING SAME

FIELD OF THE INVENTION

The present invention relates to the structure of printheads that are used in ink jet printers and the like and, more specifically, to varying the thickness of the passivation layer thereof to improve performance and protect circuit components.

BACKGROUND OF THE INVENTION

Ink jet printers are known in the art and include those made by Hewlett-Packard, Canon and Epson, among other producers. Ink jet printers function by several actuation mechanisms, including thermal (heating resistor) or mechanical (piezo-electric) actuators. While the discussion herein is primarily directed toward thermally actuated printheads, it should be recognized that the varied passivation layer thickness of the present invention are also applicable to mechanically actuated printheads. As discussed in more detail below, the present invention is concerned with providing a thick passivation layer to protect circuitry on a printhead die, while providing a thin passivation layer over the ink expulsion element to reduce ink expulsion energy. A thin passivation layer reduces the energy required to expel ink, regardless of the type of actuator and thus the present invention is applicable to all ink jet and related printers.

FIG. 1 illustrates a representative printhead structure of a prior art ink jet printhead that is thermally actuated. The structure of FIG. 1 includes a substrate 10 usually of semiconductive material in which is formed a resistive layer and element 12. A layer of conductive material 14 (usually aluminum or the like) is formed on the substrate, generally as shown. A passivation layer 20 (normally $Si_3N_4$/SiC or the like) is formed on the substrate, and a metallic layer 26 and contact pad 28 (coupled through via 25) are formed on the passivation layer. The metallic or conductive layer may include a protection/cavitation layer 24 and a surface conductor 26. An inkwell 31, barrier layer 32 and orifice plate 33 are provided as is known. A printhead "fire" signal is propagated from circuit 50 or from an off-chip source to the resistive element and there produces sufficient heat to cause a drop of ink to be expelled through the orifice plate 33.

The amount of energy required to expel a drop of ink is often referred to as the turn-on energy (TOE). TOE is related to passivation layer thickness in that the thicker the passivation layer, the more energy required to expel a drop of ink. Thus, to reduce TOE a thin passivation layer is desired.

A thin passivation layer, however, has disadvantageous aspects. One disadvantageous aspect is that as the passivation layer thickness is reduced, the likelihood of a passivation layer crack or other defect increases. To minimize the possibility of passivation layer cracking, steps such as beveling the transitions of the underlying topology, particularly those near the resistive element (which is a place of higher physical stress) have been undertaken. For example, edges 13,15 of the conductive layer 14 proximate resistive element 12 may be beveled. While beveling reduces physical stresses on the passivation layer, it is significantly more difficult to precisely position a beveled edge than to position a straight (vertical) edge. The significant margins of error in beveled edge placement result in significant variability in the defined resistor size and amount of heat generated thereby. This in turn results in inconsistent firing of the printhead and inconsistent print intensity, among other problems.

Another disadvantageous aspect of a thin passivation layer relates to the expanded use of the printhead die or substrate 10 for processing logic 50. As the number of individual firing chambers in a printhead die increases, the number of power conductors and signal conductors for these firing chambers increases. These conductors are usually formed on top of the passivation layer. As passivation layer thicknesses decrease and the provision of surface conductors increases, the likelihood of capacitive coupling or the like effecting circuitry within the substrate increases. Thus, in order to protect circuitry within the substrate, it is necessary to have a sufficiently thick passivation layer. As stated above, however, increasing passivation layer thickness disadvantageously increases the TOE.

SUMMARY OF THE INVENTION

Accordingly, it is an object of the present invention to provide a printhead structure that provides a passivation layer that is appropriately thick where necessary to protect underlying circuit components and appropriately thin where necessary to foster a low turn on energy.

It is another object of the present invention to provide methods for forming such a printhead.

It is also an object of the present invention to provide such a printhead that has a more precisely defined ink expulsion element.

These and related objects of the present invention are achieved by use of a printhead having varied thickness passivation layer and method of making same as described herein.

The attainment of the foregoing and related advantages and features of the invention should be more readily apparent to those skilled in the art, after review of the following more detailed description of the invention taken together with the drawings.

DETAILED DESCRIPTION

Figure 2:
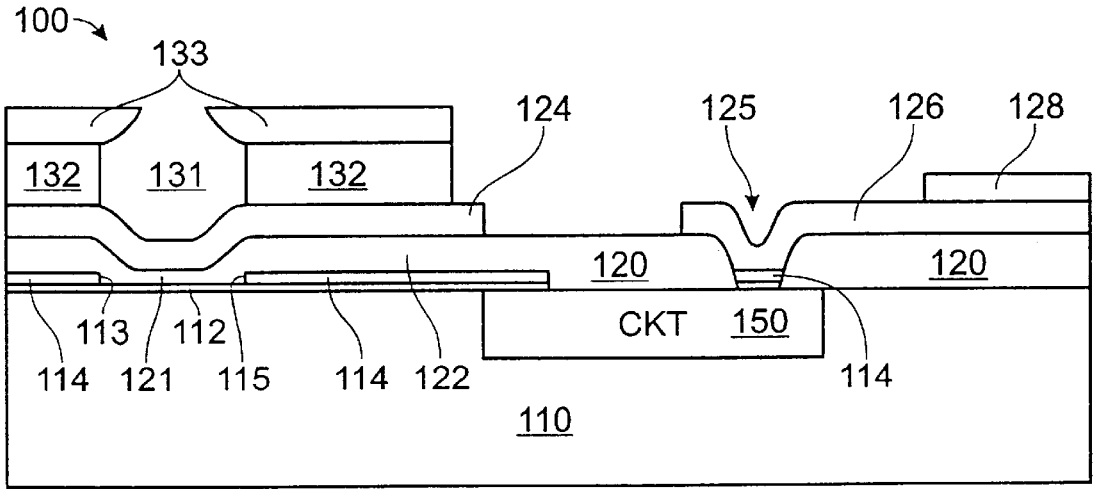
FIG. 2 is a cross-sectional view of a printhead having varied passivation layer thicknesses in accordance with the present invention.

Referring to FIG. 2, a cross-sectional view of a printhead having varied passivation layer thicknesses in accordance with the present invention is shown. The printhead 100 includes a substrate 110 on which is formed an ink expulsion (e.g., resistive) element 112, conductive layer 114, passivation layer 120, protection/cavitation layer 124, surface conductor 126 and contact pad 128. An inkwell 131, barrier layer 132 and orifice plate 133 are also provided in printhead 100. The substrate 110 in which the printhead is formed also includes control logic 150 that is coupled off die through contact pad 128 and to other locations as is known in the art. Control logic 150 may include digital and/or analog circuitry.

Printhead 100 is formed such that the passivation layer 120 includes a region 121 over ink expulsion element 112 that is relatively thin and a region 122 over circuit 150 that is relatively thick. In a preferred embodiment, ink expulsion element 112 is a resistive element or other thermal actuation element, though it should be recognized that a mechanical actuation element may be utilized.

Thinning the passivation layer from 0.75 microns to 0.38 microns achieves a TOE reduction of approximately 22%. Through methods discussed below, the passivation layer in region 121 may be reduced below 0.38 microns, for example, to 0.2 microns or below. The lower limit of passivation layer thickness is determined at least in part by the minimum thickness before breakdown of the layer due to mechanical or electrical stresses and to deleterious impact on resistor life.

In contrast, region 122 of the passivation layer can be made as thick as desired, for example, sufficiently thick to protect underlying circuitry 150. The thickness of passivation layer region 122 is preferably 1.0 micron to 1.5 micron, and can be made thicker if desired. The thickness limitations are driven by process capability and manufacturability, dry-etch considerations, number of masks, etc. In general, it is preferred that region 122 be as thick as necessary for its intended purpose without being overly thick.

Figure 1:
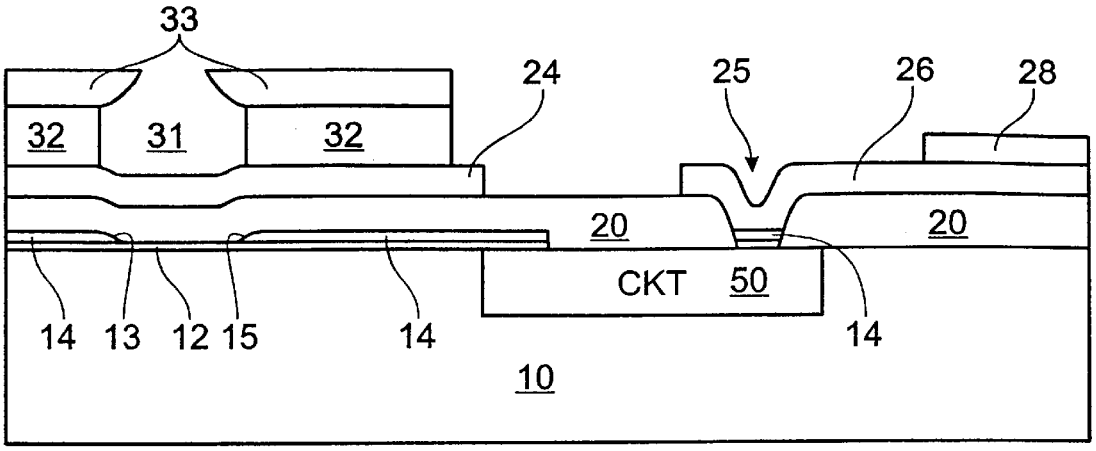
Fig. 1 (PRIOR ART)
FIG. 1 is a cross-sectional view of a conventional printhead.

The printhead of FIG. 2 is preferably not made with beveled edges on the conductive layer 114 (as discussed above with reference to FIG. 1, though beveled edges may be provided without departing from the present invention). The variable passivation layer thickness techniques of the present invention permit formation of a passivation layer over the conductive layer edges (or "steps") that is at least twice as thick as the conductive layer (and sufficiently inwardly formed from the edges in the horizontal direction as to provide enhanced breakdown protection). This thickness provides protection against cracking and the like. Furthermore, as the thickness of the conductive layer decreases, the requisite thickness of the passivation layer also decreases.

It should be recognized that by utilizing a straight (vertical) edges 113,115 on the conductive layer 114 (as opposed to beveled edges or the like), photolithographic technique may be utilized that provide much tighter control of the placement of the edges. The result is a more precisely defined resistor that in turn provides a more consistent temperature to the ink and draws a more consistent turn on energy. In addition, tighter control of the placement of the edges facilitates the manufacture of smaller geometries which result in smaller drop ejection for higher quality image printing.

The embodiment of FIG. 2 may be formed generally as follows. Starting from the substrate with the control logic and resistive element formed therein, conductive layer 114 (preferably with straight edges) is formed on this structure. A single passivation material, for example, $Si_3N_4$, is preferably formed over the conductive layer and resistive element and the remainder of the substrate. It should be recognized that while $Si_3N_4$ is preferred, layer 121 could be formed of another known passivation layer material or a combination of materials. The thickness of the initial passivation layer is preferably approximately 1 micron or other desired thickness. This initial passivation layer is then etched over the resistive element to form the thin passivation layer of region 121. The passivation layer may be etched to a thickness of 0.2 microns or another appropriate dimension determined by the designer and limited by processing tolerances. The clearing of via 125 will typically require a separate photolithographic/etch step. The etched passivation layer is then covered where appropriate with a material such as tantalum or the like. Tantalum provides a cavitation surface 124 under ink well 131 and is also a suitable conductor for surface conductor 126. The tantalum is preferably applied to an approximate thickness of 0.6 microns. Contact pads 128 are then formed on the tantalum layer and these contact pads are preferably formed of gold.

Figure 3:
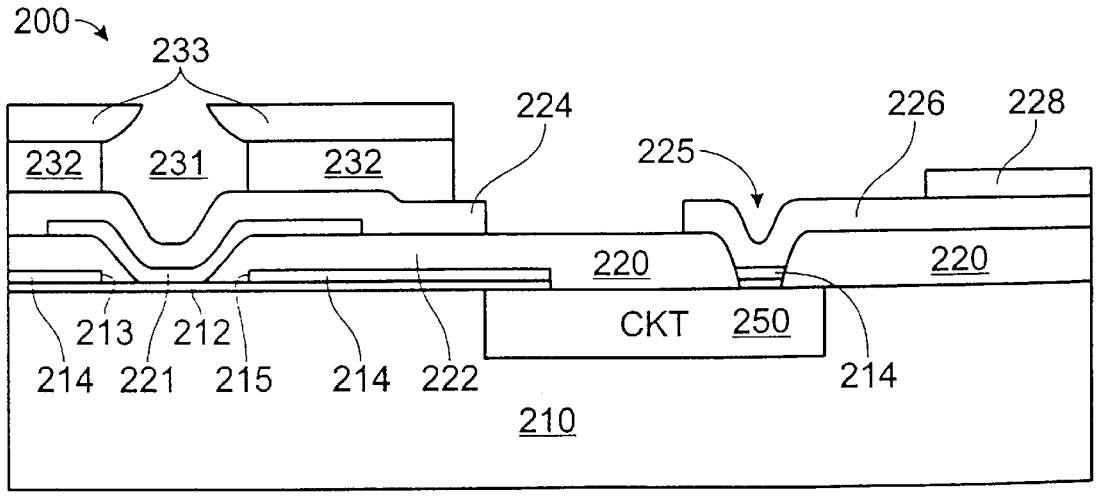
FIG. 3 is an alternative embodiment of a printhead having varied passivation layer thicknesses in accordance with the present invention.

Referring to FIG. 3, an alternative embodiment of a printhead with varied passivation layer thicknesses in accordance with the present invention is shown. FIG. 3 illustrates a printhead having substantially the same components as in FIG. 2. Components of the printhead of FIG. 3 that correspond to components of the printhead of FIG. 2 have the same reference numeral with the most significant digit replaced with a 2.

Printhead 200 is preferably formed in a manner discussed above for printhead 100, however, during the passivation layer etch over the resistive element, a complete etch is preferably performed, thus exposing the resistive element. A thin passivation layer (e.g., $Si_3N_4$ and/or SiC or both) is then reformed over the resistive element. The new layer of material forms passivation layer region 221. This etch and selected refill method is performed in such a manner as to provide sufficient spacing from edges 213,215 such that adequate passivation layer protection (i.e., breakdown protection) is provided. Tantalum and gold are then applied as discussed above or other conventional photolithographic process steps may be carried out. The complete etch and refill method permits more accurate control of the thickness of region 221. It does, however, require additional mask operations.

It should be recognized that the thicker passivation layer of the present invention is beneficial in protecting the front side of the substrate during a TMAH etch and the like. TMAH etches and the like are performed to remove portions of the substrate and thus create ink conduits.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A printhead apparatus, comprising:

a substrate;

a fluid expulsion element formed on said substrate;

a first passivation layer formed over at least a portion of said substrate;

a second passivation layer formed over a part, less than whole, of said first passivation layer; and a fluid well formed over said fluid expulsion element;

wherein a thickness of said second passivation layer is less than a thickness of said first passivation layer; and wherein said second passivation layer is formed proximate said fluid expulsion element and in contact therewith.

2. The apparatus of claim 1, further comprising processing logic formed in said substrate under said first passivation layer.

3. The apparatus of claim 1, wherein said second passivation layer has a thickness of approximately 0.4 microns or less over said ink expulsion element.

4. The apparatus of claim 1, wherein said first passivation layer has a thickness of approximately 0.6 microns or more.

5. The apparatus of claim 1, wherein said second passivation layer includes at least one of SiN, SiC, or both SiN and SiC.

6. The apparatus of claim 1, further comprising a protection layer formed on said second passivation layer over said fluid expulsion element, said protection layer having a cavitation surface formed thereon.

7. The apparatus of claim 1, wherein said fluid expulsion element is thermally actuated.

8. The apparatus of claim 1, further comprising a conductive layer provided adjacent said fluid expulsion element for delivering an electrical signal to said ink expulsion element wherein said conductive layer has a substantially vertical edge proximate said ink expulsion element.

9. A printhead apparatus, comprising:

a substrate;

a fluid expulsion element formed on said substrate;

a first passivation layer formed over at least a portion of said substrate;

a second passivation layer formed over a part, less than whole, of said first passivation layer; and a fluid well formed over said fluid expulsion element;

wherein a thickness of said second passivation layer is less than a thickness of said first passivation layer; and wherein said first and second passivation layers are configured over said substrate to define a first, a second and a third region, said first region being comprised substantially of said second passivation layer, said second region being comprised substantially of said first and said second passivation layers, and said third region being comprised substantially of said first passivation layer.

10. The apparatus of claim 9, wherein the combined thickness of the first and second passivation layers in said second region is approximately 0.6 $\mu$m or more.

11. The apparatus of claim 9, wherein said first region is provided over at least part of said fluid expulsion element, said second region is provided proximate said first region and said third region is provided proximate said second region.

12. The apparatus of claim 11, wherein the thickness of the second passivation layer over said fluid expulsion element in said first region is approximately 0.4 $\mu$m or less.

13. The apparatus of claim 9, further comprising a cavitation layer formed over said second passivation layer.

14. The apparatus of claim 9, wherein said first passivation layer includes SiN.

15. The apparatus of claim 9, wherein said second passivation layer includes at least one of SiN, SiC or both SiN and SiC.

* * * * *